US009124018B2

(12) United States Patent
Suzuki

(10) Patent No.: US 9,124,018 B2
(45) Date of Patent: Sep. 1, 2015

(54) CONNECTOR AND METHOD OF MAKING THE SAME

(71) Applicant: Yazaki Corporation, Tokyo (JP)

(72) Inventor: Toshifumi Suzuki, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/284,908

(22) Filed: May 22, 2014

(65) Prior Publication Data

US 2014/0256196 A1 Sep. 11, 2014

Related U.S. Application Data

(63) Continuation of application No. PCT/JP2012/007428, filed on Nov. 20, 2012.

(30) Foreign Application Priority Data

Nov. 24, 2011 (JP) ..... 2011-256098

(51) Int. Cl.
*H01R 13/422* (2006.01)
*H01R 43/24* (2006.01)
*H01R 13/436* (2006.01)

(52) U.S. Cl.
CPC ..... *H01R 13/4226* (2013.01); *H01R 13/4223* (2013.01); *H01R 13/4361* (2013.01); *H01R 43/24* (2013.01); *Y10T 29/4922* (2015.01)

(58) Field of Classification Search
CPC .... H01R 13/652; H01R 9/0518; H01R 13/11; H01R 13/111; H01R 13/4223; H01R 13/4362; H01R 13/4364; H01R 13/465; H01R 13/642; H01R 13/65802; H01R 13/73; H01R 2103/00; H01R 24/40; H01R 9/05
USPC ..... 439/595, 752, 746
See application file for complete search history.

(56) References Cited

U.S. PATENT DOCUMENTS 4,944,696 A * 7/1990 Sueyoshi et al. ..... 439/595
4,969,841 A 11/1990 Sueyoshi et al.

(Continued)

FOREIGN PATENT DOCUMENTS

JP 64-054678 A 3/1989
JP 2-126376 U 10/1990

(Continued)

OTHER PUBLICATIONS

International Search Report and Written Opinion mailed Apr. 29, 2013, issued for PCT/JP2012/007428.

(Continued)

*Primary Examiner* — Briggitte R Hammond
(74) *Attorney, Agent, or Firm* — Locke Lord LLP

(57) ABSTRACT

There is provided a connector and a method for making the connector preventing escape of a terminal fitting by improving latch force for the terminal fitting over a wide variety of products without inducing upsize or manufacturing cost. The connector comprises a connector housing including a terminal fitting and a terminal housing accommodating the terminal fitting, in which the connector housing includes a wall composing one inner face of the terminal housing, and a latch part latching the terminal fitting, the latch part including a latch arm having a tip extending from a base end disposed the inner face of the wall toward a back side in an insertion direction of the terminal fitting, a latch projection projecting from the latch arm in a direction intersecting the insertion direction.

8 Claims, 8 Drawing Sheets

(56) References Cited

U.S. PATENT DOCUMENTS

| | | | | | |
|---|---|---|---|---|---|
| 5,586,917 | A | * | 12/1996 | Yagi et al. | 439/752 |
| 5,609,503 | A | * | 3/1997 | Tsuji et al. | 439/752 |
| 5,797,772 | A | * | 8/1998 | Sakurai et al. | 439/752 |
| 6,080,005 | A | * | 6/2000 | Aoyama et al. | 439/397 |
| 6,146,174 | A | * | 11/2000 | Maeda et al. | 439/271 |
| 6,315,601 | B1 | * | 11/2001 | Sasaki et al. | 439/488 |
| 6,328,614 | B1 | * | 12/2001 | Osawa | 439/752 |
| 2001/0039151 | A1 | * | 11/2001 | Tsuji et al. | 439/752 |
| 2014/0256196 | A1 | * | 9/2014 | Suzuki | 29/883 |

FOREIGN PATENT DOCUMENTS

| | | | |
|---|---|---|---|
| JP | 2007-115614 | A | 5/2007 |
| JP | 2010-073357 | A | 4/2010 |
| JP | 2011-108576 | A | 6/2011 |

OTHER PUBLICATIONS

Office Action mailed Jun. 9, 2015, issued for the Japanese patent application No. 2011-256098 and English translation thereof.

* cited by examiner

CONNECTOR AND METHOD OF MAKING THE SAME

TECHNICAL FIELD

This invention relates to a connector that composes a wire harness wired in an automobile, and a method of making the connector.

BACKGROUND ART

An automobile as a moving vehicle has various electric devices mounted therein, where a wire harness for transferring power or control signal is wired. The wire harness is provided with a plurality of electric wires and connectors, with which the connectors are engaged with a connector of the electric devices or other wire harness so as to be connected with the electric devices or other wire harness.

A connector applied to such the connector generally includes a tubular connector housing and a terminal fitting accommodated in the connector housing and attached to a terminal of the electric wire, of which various types are employed corresponding to usage environment or object.

Generally, a terminal fitting of the connector is formed such as to bend conductive metal plate, which the terminal fitting is provided with an electric wire connection part connected with the electric wire of the wire harness and an electric wire contact connected with a terminal fitting of a mating connector. The connector housing is provided with a straight hole-like terminal housing accommodating the terminal fitting therein, and a latch lance projecting into the terminal housing, and elastically formed to latch the terminal fitting in the terminal housing.

In such the connector, latch of the terminal fitting only by the latch lance stands insufficient of latch force, likely resulting in escape of the terminal fitting from the connector housing upon wiring in such assembly work for the wire harness. In order to prevent the terminal fitting from escaping from the connector housing, there has thereby been advocated such a connector having a spacer (e.g., see PTLs 1 and 2) or a front holder (e.g., see PTL 3) as an actual latch avoiding escape of the terminal fitting from the connector housing.

A connector 100 describe in PTL 1, as shown in FIGS. 9 and 10, provided with a connector housing 101, a spacer 102, and a female terminal fitting 103 (herein, referred to as female terminal) to which electric wire is connected. The connector housing 101 is formed of such insulating synthetic resin in generally a box shape, provided with a terminal housing 104 (terminal housing) accommodating a female terminal 103, and a spacer housing 105 (through hole) accommodating the spacer 102. Note that because a connector recited in PTL 2 includes nearly similar components too, the connector 100 of PTL 1 will herein be discussed.

The terminal fitting 104 is plurally arranged in parallel, each straightly extending, longitudinal both ends of which are open communicating with an end face of the connector housing 101. In the terminal housing 104 the female terminal 103 is inserted in its longitudinal direction, and is formed a latch lance 106 facing inside the terminal housing 104 in its back side in an insertion direction. The spacer housing 105 is depressed from one outer face of a plurality of outer faces of the connector housing 101 which intersects a longitudinal direction of the terminal housing 104, disposed across nearly middle in its longitudinal direction of each terminal housing 104.

The spacer 102 is made of insulating synthetic resin, provided with a plurality of insertion pins 107 inserted into the spacer housing 105, and a latch projection 108 disposed in each insertion pin 107. The latch projection 108 is formed vertically two-tire at a side face of each of insertion pins 107, between the two-tire latch projections 108 is formed a space into which the female terminal 103 is allowed to insert. When such the spacer 102 is inserted into the spacer housing 105, a tip of the insertion pin 107 is latched in the connector housing 101 so as to be positioned at a provisional latch position.

A space between the insertion pin 107 and the latch projection 108 of the spacer 102, and the terminal housing 104 communicate with each other, with the spacer 102 positioned in the provisional latch position, so as to allow the female terminal 103 to be inserted into the terminal housing 104. Insertion of the female terminal into the terminal housing 104 then makes the latch lance 106 elastically deformed to latch a recess of the tip of the female terminal 103 therein. In this provisional latch position of the female terminal 103, insufficiency of a latch force by the latch lance 106 likely causes the female terminal 103, upon being pulled with powerful force, to escape from the connector housing 101.

Therefore, further insertion of the spacer 102 positioned at the provisional latch position into the spacer housing 105, as shown in FIG. 10B, has a main body of the spacer 102 latched in the connector housing 101 so as to be positioned at the actual latch position. Positioning of the spacer 102 at the actual latch position makes the latch projection 108 project in the terminal housing 104 so as to latch the projection 103A of a middle of the female terminal 103. As such the spacer 102 positioned at the actual latch position prevents the female terminal 103 from escaping from the connector housing 101.

On the other hand, a connector described in PTL 3, as shown in FIGS. 11 and 12, is provided with a connector housing 111, a front holder 112, and a female terminal fitting 113 (hereinafter, referred to as female terminal). The connector housing 111 is provided with a terminal housing 114 accommodating the female terminal 113, to an inside of which a latch lance is formed to face. The latch lance 115 is formed slanted from a wall 116 of the terminal housing 114 toward backside of the female terminal 113 in its insertion direction, and between the latch lance 115 and the wall 116 a space 117 is formed.

The front holder 112 is attached from front side of the connector housing 111, provided with a front part 118 having a through hole passing male terminal fitting of other connector therethrough, and restriction projection 119 projecting from the front part 118 to be inserted into the terminal housing 114 of the connector housing 111. The restriction projection 119 enters into the space 117 between the latch lance 115 and the wall 116 when the front holder 112 is attached to the connector housing 111 so as to restrict deformation of the latch lance 115.

In such the connector 110, insertion of the female terminal 113 into the terminal housing 114 of the connector housing 111 makes the latch lance 115 elastically deformed so as to latch a recess 113A of the female terminal 113 therein. In the provisional latch state of the female terminal 113, the front holder 112 is attached from a front side of the connector housing 111, and the restriction projection 119 is inserted into the space 117. Elastic deformation of the latch lance 115 is thereby restricted, lying in an actual latch state latch of the recess 113A of the female terminal 113 is not released, which prevents the female terminal 103 from escaping from the connector housing 101.

CITATION LIST

Patent Literature

[PTL 1]
Japanese Patent Application Laid-Open Publication No. S64-54678

[PTL 2]

Japanese Patent Application Laid-Open Publication No. 2007-115614

[PTL 3]

Japanese Patent Application Laid-Open Publication No. 2011-108576

SUMMARY OF INVENTION

Technical Problem

Disadvantageously, such the conventional connector as shown in the aforementioned PTLs 1 to 3 is not allowed to increase latch force of the terminal fitting unless a spacer or a front holder is laid in actual latch state, by the connector housing being inserted thereinto, resulting in difficulty of prevention of escape of the terminal fitting in preliminary latch state. Namely, as a connector there are various connectors that are not provided with the spacer 102 or the front holder 112, but not limited to those provided therewith, or have different configurations or sizes. It is not thereby actual for various connectors to all have the spacer or the front holder, and also providing of the spacer or the front holder for increasing of the latch force of the terminal fitting induces various drawbacks such as upsizing the connector, requiring of sophisticated equipment for molding due to complication of its configuration, or cost-up for manufacturing and running.

Accordingly, an object of the present invention is to provide a connector and a method of making the connector preventing its escape by increasing latch force of a terminal fitting for various products without inducing of its upsizing or increasing of manufacturing cost.

Solution to Problem

In order to attain the above-mentioned object, a connector according to a first aspect of the present invention, comprises: a terminal fitting including a first latched part and a second latched part; and a connector housing, including a terminal housing accommodating the terminal fitting, a wall dividing the terminal housing from external, composing one inner face of the terminal housing, and provided with a through hole passing therethrough, and a latch part configured to latch the terminal fitting accommodated in the terminal housing so as to avoid escape of the terminal fitting, the latch part including a latch arm having a tip extending from a base end disposed on the inner face of the wall toward a back side in an insertion direction of the terminal fitting, the tip of the latch arm being configured to be latched into the first latched part, and a latch projection projecting from the latch arm in a direction intersecting the insertion direction of the terminal fitting, exposing to external through the through hole, and configured to be latched into the second latched part.

By applying the aforementioned configuration, the latch part includes the latch arm and the latch projection, the first latched part of the terminal fitting being latched by the tip of the latch arm, the second latched part of the terminal fitting being latched by the latch projection, i.e., latch of the terminal fitting at at least two points increases latch force, leading to prevention of escape of the terminal fitting. Also, forming of the through hole letting the latch projection face external at the wall of the connector housing readily forms the latch projection that is formed to project toward the insertion direction of the terminal fitting. Namely, the connector housing is generally made of insulating synthetic resin by injection-molding, the terminal housing is formed in the insertion direction of the terminal fitting (hereafter, referred to as a first direction sometimes), and thereby a mold operable to open in the first direction is employed. This makes it difficult to mold the latch projection because of projection of the latch projection in a direction intersecting the first direction, but forming the through hole on the wall of the connector housing and the latch projection being positioned such as to face external via the through hole makes it possible to readily mold the latch projection using a slide mold that is passed through the through hole.

Preferably, the inner face of the wall is provided with a guide groove therein, the guide groove extending from an inlet side to the back side in the insertion direction of the terminal fitting in the connector housing, and wherein the terminal fitting is provided with a projection piece configured to be inserted into the guide groove and guided in the insertion direction of the terminal fitting, and wherein the second latched part is composed of a part of the projection piece.

By applying the aforementioned configuration, the terminal fitting can be provided with a projection piece guided along the guide groove of the connector housing, thereby preventing the terminal fitting from rotating or slanting upon being inserted into the connector housing, which prevents the connector housing or the terminal fitting from breaking by irregular insertion, as well as improve workability of insertion. Also, configuration of the second latched part by projection piece for guiding the terminal fitting (referred to as stabilizer), and latch of a part of the projection piece by the latch projection eliminates a need to form the additional second latched part, decreasing manufacturing cost for the terminal fitting. Note that the projection piece of such the stabilizer is generally formed projecting in a direction intersecting the insertion direction of the terminal fitting, and by such the projecting part being latched by the latch projection, a first latch position where the first latched part is latched by the tip of the latch arm and a second position where the projection piece is latched by the latch projection can be separated apart from each other. Therefore, latch of the terminal fitting at two positions apart from each other, even if latch is released upon outer force exerting on one of the positions, allows latch of the other to be kept so as to likely keep a latch state of the terminal fitting.

Preferably, the back side in the insertion direction of the terminal fitting in the terminal housing is provided with an abutting part therein, the abutting part abutting against, and holding a tip of the accommodated terminal fitting, and wherein the abutting part and the latch projection are overlapped to each other in the insertion direction of the terminal fitting.

By applying the aforementioned configuration, formation of the abutting part at the back side of the terminal housing, and abutting of the abutting part against, and holding of the tip of the accommodated terminal fitting makes it possible to well hold the terminal fitting in the connector housing in a predetermined position and arrangement. Also, the abutting part and the latch projection being stacked to each other in the insertion direction of the terminal fitting makes the abutting part abut against the tip of the terminal fitting without widening its width size of the terminal fitting in the direction intersecting the insertion direction of the terminal fitting, and makes the second latched part of the terminal fitting latched in the latch projection. Though it becomes difficult to position a mold for molding the latch projection at the back side of the terminal housing (that is, a front side of the connector housing) due to the abutting part being positioned at the back side of the terminal housing, insertion of the slide mold through the through hole of the connector housing that is not positioned at the back side of the terminal housing as noted makes the latch projection molded while avoiding interference with the abutting part.

Preferably, a method for making the connector comprises the steps of: providing a slide mold slidable in the direction intersecting the insertion direction of the terminal fitting upon molding the connector housing; passing the slide mold through a part where the through hole is destined to is formed; and molding the latch projection using the slide mold.

By applying the aforementioned configuration, in much the same fashion as the forgoing connector, even with the latch projection projecting to intersect the first direction, insertion of the slide mold through the part of the through hole to be formed in the wall of the connector housing and molding the latch projection with the slide mold makes it possible to readily mold the latch projection. It is therefore made possible to avoid complication of facility or equipment for manufacturing the connector housing, avoiding cost-up for manufacturing.

Advantageous Effects of Invention

According to the invention, since latch of the terminal housing at at least two points can increase latch force so as to prevent escape of the terminal fitting, avoiding necessarily providing a spacer or a front holder as is the case for the conventional connector, it is made possible to correspond to various types of connectors, and avoid upsize of the connector or complication of its configuration so as to restrict manufacturing cost. Also, since utilizing the through hole disposed in the wall of the connector housing, the latch projection is readily molded with the slide mold, manufacturing cost for the connector housing can be further decreased.

According to the invention, latch of the projection piece such as a stabilizer disposed in the terminal fitting by the latch projection makes it possible to keep its latch state of the terminal housing, and to securely prevent its escape of the terminal fitting. Also, with a terminal fitting originally having a stabilizer, it is not necessary to redesign to form the additional second latched part, directly utilizing the terminal fitting, it is thereby made possible to decrease manufacturing cost and improve latch force.

According to the invention, since the latch projection can be molded without interference with the abutting part, it is made to prevent escape of the terminal fitting and well hold it in the predetermined position.

According to the invention, it is made possible to avoid complication of facility or equipment for manufacturing the connector housing, as well as to make the connector improving its latch force corresponding to various types of products regardless of presence or absence of the spacer or the front holder.

DESCRIPTION OF EMBODIMENTS

Hereinafter, a connector relevant to one embodiment of the present invention will be discussed with reference to FIGS. 1 to 8. A connector 1 relevant to the present embodiment is the one composing a wire harness wired in such an automobile, which is engaged and connected with a mating connector provided with various electric devices or other wire harness mounted in such the automobile. The wire harness is provided with a plurality of electric wires 2, and the connector 1. The electric wire 2 is provided with a conductive core wire and an insulating cover covering the core wire, an end of which is crimped onto a terminal fitting 3 of the connector 1.

Figure 1:
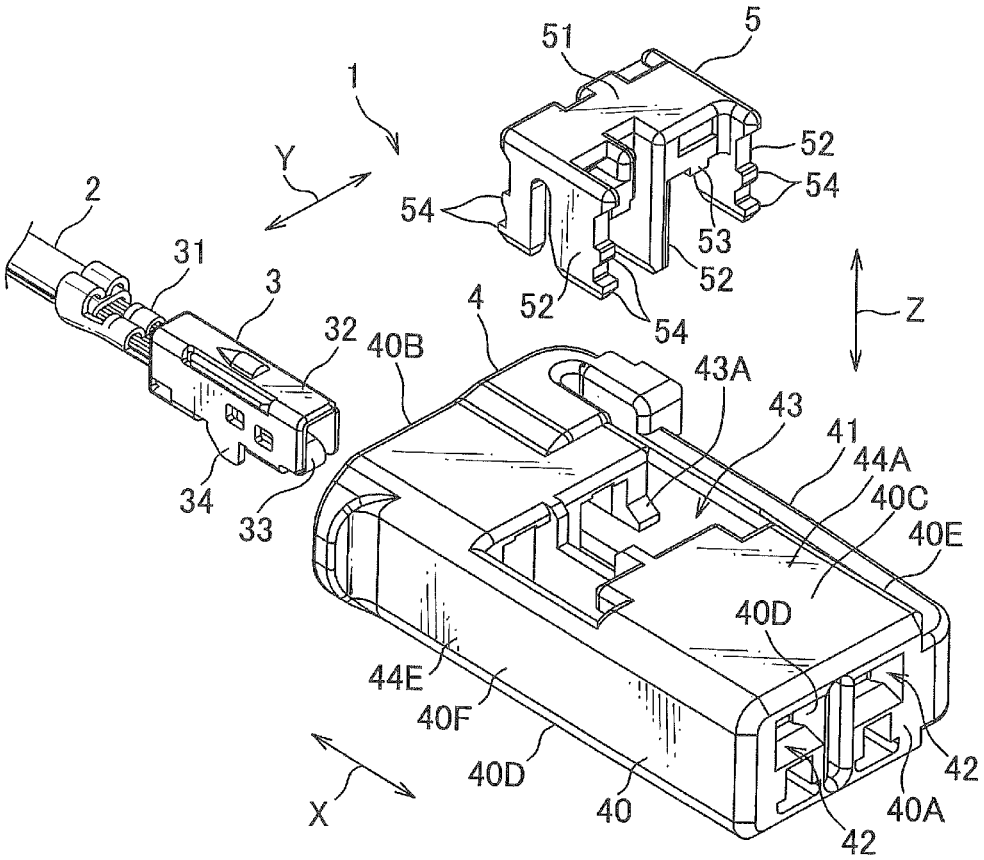
FIG. 1 is a perspective view illustrating a connector according to one embodiment of the present invention.

As shown in FIG. 1, the connector 1 is provided with a terminal fitting 3 that is what is called a female terminal fitting, a connector housing 4 accommodating the terminal fitting 3, a spacer 5 to be inserted into the connector housing 4. That is, the connector 1 is a female connector provided with the terminal fitting 3 that is the female-type terminal fitting, which is engaged, and connected, with the mating male connector. Note that in the present embodiment the connector 1 illustrated and described is female connector, but that the connector of the present invention may be a male connector.

The terminal fitting 3 is formed by punching and bending, integrally provided with an electric wire connection part 31 and an electric contact part 32. The electric wire connection part 31 is provided with a strip bottom plate and a swaging piece continuous with widthwise both ends of the bottom plate, onto which the bottom plate the electric wire 2 the core wire of which is exposed is placed, and swaging an end of the electric wire 2 makes the swaging piece electrically and mechanically connected with the electric wire 2.

The electric contact 32 is square-shaped, continuous with the bottom plate of the electric wire connection part 31. In the electric contact part 32 is disposed an elastic piece 33 into which a male terminal fitting of the not-shown mating connector is inserted and held between an inside of the electric contact 32 and itself. As such holding of the male terminal fitting between the inside of the electric contact 32 and the elastic piece 33 makes the terminal fitting 3 and the male terminal fitting electrically and mechanically connected to each other.

Also, the electric contact 32 is provided with a stabilizer 34 as a projection piece projecting from one side of its square tubular. The stabilizer 34 is inserted into an after-mentioned guide groove 46 inside the connector housing 4, guided along the guide groove 46. The stabilizer 34 is inserted into the guide groove 46 so that it is made possible to insert the terminal fitting 3 into the connector housing 4 in a predetermined direction, in addition, the stabilizer 34 is guided to the guide groove 46 so that it is made possible to prevent the terminal fitting 3 from collapsing or being slanted (that is, in an arrow X direction in such FIG. 1).

Figure 2:
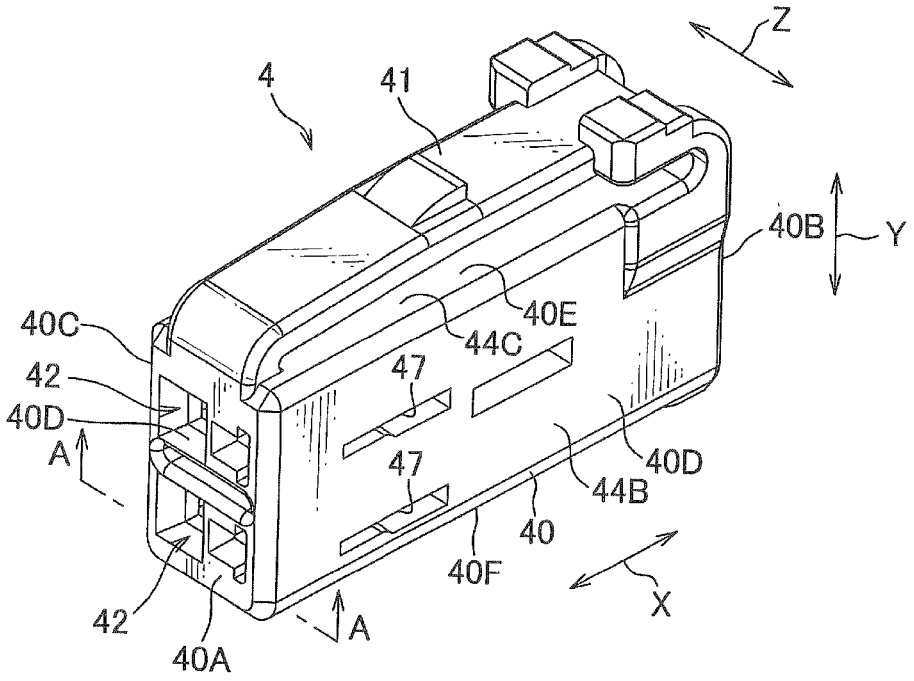
FIG. 2 is a perspective view illustrating a connector housing of the connector.
Figure 3:
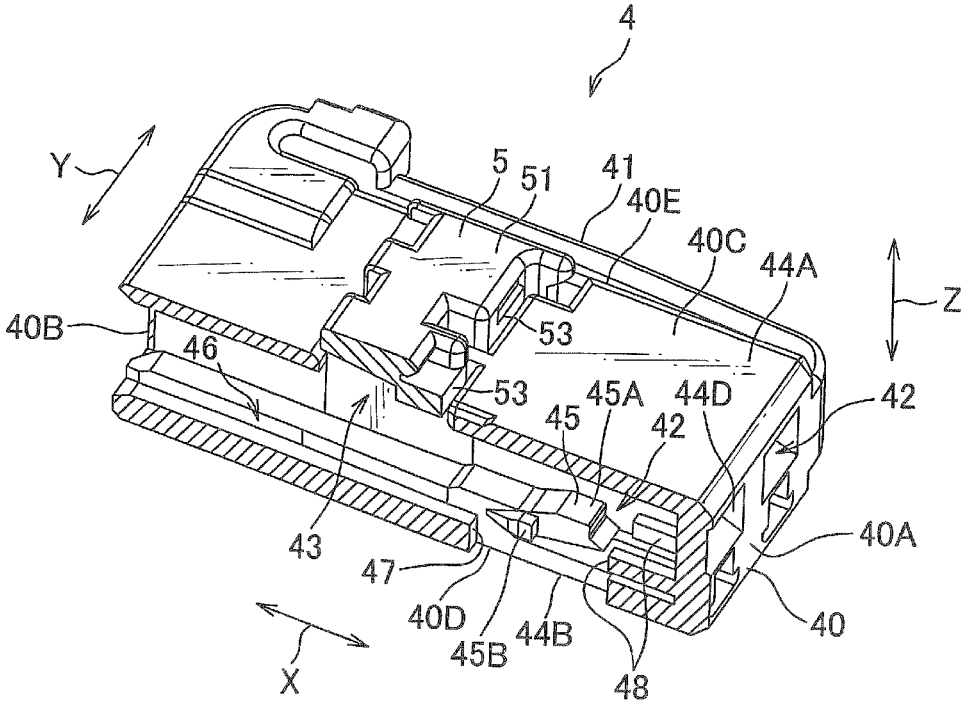
FIG. 3 is a perspective view illustrating a cross-section of the connector housing taken at a position shown from A-A line in FIG. 2.

The connector housing 4 is made of insulating synthetic resin, as shown in FIGS. 1 to 3, provided with a box-like housing main body 40, a lock arm 41 for latching the mating connector. The housing main body 40 is provided with a terminal housing 42 accommodating the terminal fitting 3, a spacer housing 43 accommodating the spacer 5.

Also, the housing main body 40 is provided with a front face 40A facing the mating connector, a back face 40B opposite to the front face 40A where the terminal fitting 3 is inserted into, an upper face 40C where the spacer 5 is inserted into, a bottom face 40D opposite to the upper face 40C, a first side face 40E where the lock arm 41 is disposed, and a second face 40F opposite to the first side face 40E. Note that herein, such the upper face 40C or bottom face 40D is conveniently referred to as for simply describing, but not limited to up, down, right or left direction in usage condition of the connector 1.

The terminal housing 42 is provided plurally (two in the present embodiment), and arranged in parallel to each other. The plurality of terminal housings 42 is straight tube-shaped extending in a front-rear direction of the connector housing 4, both ends of which in its longitudinal direction are open to and communicating with the front face 40A and the back face 40B of the housing main body 40. Of the two terminal housings 42 the terminal housing 42 right side in FIG. 1 and upper side in FIG. 2 is surrounded by an upper wall 44A composing the upper face 40C of the housing main body 40, a bottom wall 44B composing the bottom face 40D, a first side wall 44C composing the first side face 40E, and a middle wall 44D disposed across the upper wall 44A and the bottom wall 44B. On the other hand, the terminal housing 42 left side in FIG. 1 and lower side in FIG. 2 is surrounded by the upper wall 44A, the bottom wall 44B, a second side wall 44E composing the second side face 40F, and the middle wall 44D.

Into inside such the terminal housing 42 the terminal fitting 3 is inserted from the back face 40B of the housing main body 42 in its longitudinal direction, which the direction the terminal fitting 3 is inserted is shown by the arrow X in such FIG. 1, which is called an insertion direction X of the terminal fitting 3. Also, a direction intersecting the insertion direction X of the terminal fitting 3 and opposing the first side wall 44C and the second side wall 44E is shown in an arrow Y, which is called a first intersection direction Y, a direction intersecting the insertion direction X and opposing the upper wall 44A and the bottom wall 44B is shown in an arrow Z, which is called a second intersection direction Z. Note that inside the terminal housing 42 the back face 40B of the housing main body 40 may be referred to as an inlet side of the insertion direction X, and the front face 40A side as a back side of the insertion direction X.

Figure 4A:
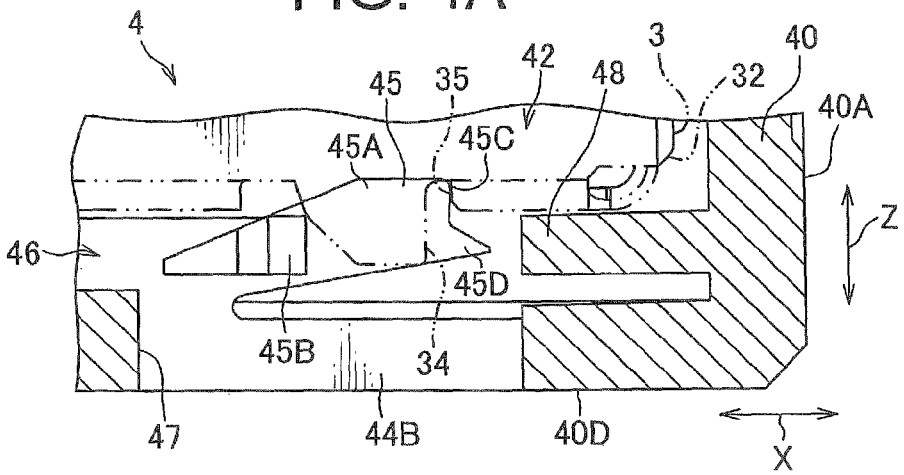
FIG. 4A is a cross-sectional view illustrating an enlarged main part of the connector housing.
Figure 4B:
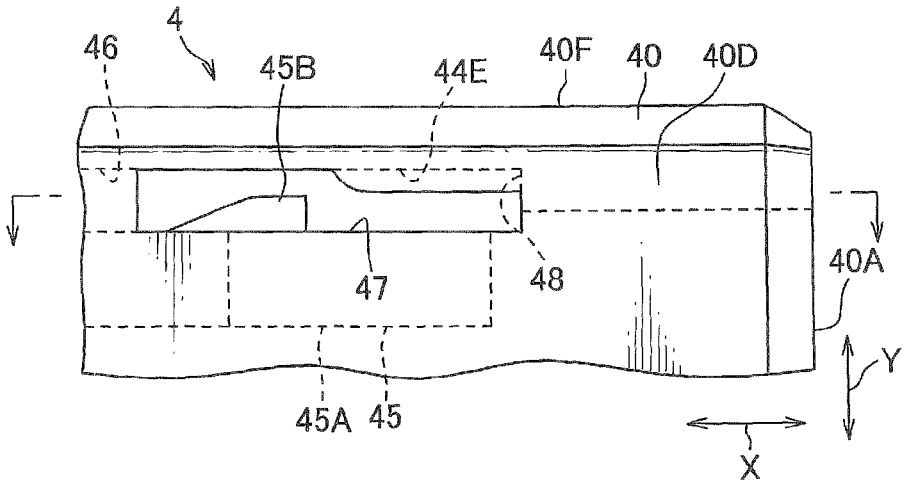
FIG. 4B is a plane view illustrating an enlarged main part of the connector housing.
Figure 5:
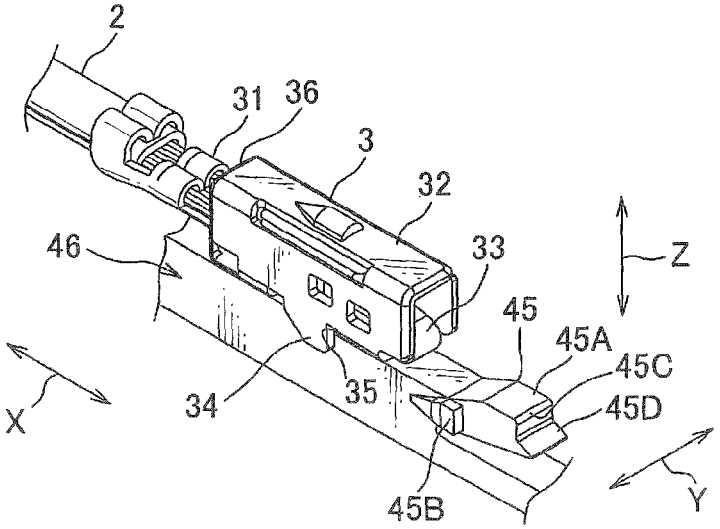
FIG. 5 is a partial perspective view illustrating a procedure of latch of a terminal fitting in the connector.

Inside each terminal housing 42 as shown in FIGS. 3 to 5, a latch lance 45 is disposed as a latch part. The latch lance 45 is designed to restrict escape of the terminal fitting 3 from the terminal housing 42 by latching the terminal fitting 3. The latch lance 45 is provided with a latch arm 45A extending in a cantilever-like fashion from the bottom wall 44B toward a back side of the insertion direction X, and a latch arm 45B projecting from the base end of the latch arm 45A. The latch arm 45A, whose base end is in continuous with inside the bottom wall 44B, extend slanted toward the back side of the insertion direction X and toward the upper wall 44A of the second intersection direction Z. Also, the latch arm 45A is formed in such a way that a free end of tip thereof becomes elastic toward the bottom wall 44B, and the terminal fitting 3 bridging across the bottom wall 44B while deforming is latched in the tip 45C of the latch arm 45A.

Herein, the terminal fitting 3 is provided with a step 35 as a first latched part disposed recessed from outer face at front side nearer than the stabilizer 34 of the electric contact 32, which is configured to have the tip 45C of latch arm 45A latched therein. Also, in the tip of the latch arm 45A a latch release projection 45D is disposed. To the latch release projection 45D a jig for pulling the terminal is hooked to deform the latch arm 45A, allowing the latch arm 45A and the step 35 to be unlatched from each other.

The latch projection 45B projects from a base end of the latch arm 45A toward the second side wall 44E side of the first intersection direction Y, and is formed slanted in such a way as to approach the second side wall 44E as approaching the back side of the insertion direction X. The latch projection 45B is formed elastic toward the bottom wall 44B with the latch arm 45A elastically deformed, and elastic in a direction separating from the second side wall 44E (a direction submerging into the latch arm 45A), and the stabilizer 34 of the terminal fitting 3 that bridges across the latch projection 45B while elastically deforming the latch projection 45B is designed to be latched in the latch projection 45B. Also, in an intersection of the bottom wall 44B of the housing main body 40 and the second side wall 44E is formed a guide groove 46 extending in the insertion direction X and guiding the stabilizer 34. Namely, the latch projection 45B is formed projecting from the guide groove 46.

In the bottom wall 44B of the housing main body 40 a slit 47 is, as shown in FIGS. 2 to 4, formed as a through hole passing through the bottom wall 44B positioned corresponding to each of the terminal housings 42. The slit 47 runs along the guide groove 46, formed along a side face of the latch arm 45A, so as to have the latch projection 45B face external through the slit 47. Namely, nearly the entire bottom face of the latch projection 45B is, when viewing the housing main body 40 from the bottom face 44B side, made to be exposed to external through the slit 47. Lock of the stabilizer 34 by such the latch projection 45B can be released by elastically deforming the latch projection 45B using a jig inserted though the slit 47. As noted, after releasing the latch of the latch arm 45A and the step 35, as well as releasing latch of the latch projection 45B and the stabilizer 34, pulling the electric wire 2 and moving the terminal fitting 3 toward the inlet side in the insertion direction X allows the terminal fitting 3 to be pulled out of the terminal housing 42.

In the back side in the insertion direction X inside the terminal housing 42 is formed a abutting part 48 abutting against the electric contact 32 of the inserted terminal fitting 3. The abutting part 48, by holding the electric contact 32 between the upper wall 44A and itself, positions and holds the terminal fitting 3, arranged in pairs in the first intersection direction Y. Also, the abutting part 48 is stacked in the insertion direction X of the terminal fitting 3 relative to the latch projection 45B. Namely, the abutting part 48 and the latch projection 45B are, as shown in FIG. 4A, arranged at nearly the same position in the second insertion direction Z, and as shown in FIG. 4B project oppositely to each other along the first intersection direction Y over each of their tip, facing at least an each of their parts along the insertion direction X.

The spacer 5 is, as shown in FIGS. 1 and 3, provided with a spacer main body 51 parallel to the upper wall 44A of the housing main body 40, a plurality of insertion pieces 52 extending from the spacer main body 51 to be inserted into the spacer housing 43. In the spacer main body 51, at the actual latch position the spacer is entirely accommodated, is formed a restriction piece 53 lying inside each of the terminal housings 42 and operable to abut against the terminal housing 3. Also, in the spacer housing 43 is formed a latch piece 43A latching the spacer main body 51 at the actual latch position. On the other hand, of the plurality of insertion pieces, the two inserting pieces 52 of both sides have a projection 54 to be latched inside the first and second side walls 44C and 44E of the housing main body 40 at a provisional latch position a part of the spacer 5 is accommodated in the spacer housing 43. Also, the middle inserting piece 52 with the spacer 5 accommodated in the spacer housing 43 continue to the middle wall 44D, each composed of partition wall between the terminal housings 42.

Such the spacer 5, at the provisional latch position the projection 54 is latched inside the first and second side walls 44C and 44E of the housing main body 40, allows the terminal fitting 3 to escape from the terminal housing 42, and at an actual latch position the spacer main body 51 is latched in the latch piece 43A, restricts the terminal fitting 3 from escaping from the terminal housing 42. The spacer 5 is, across such the provisional latch position and the actual latch position, movably attached to the connector housing 4. Also, by the restriction piece 53 positioned inside the terminal housing 42 abutting against a rear edge 36 (see FIGS. 5 and 7) of the electric contact 32 at the actual latch position, the spacer 5 can restrict the terminal fitting 3 from escaping.

Hereinafter, the foregoing method will be discussed with reference to FIGS. 6 to 8B. Firstly, the terminal fitting 3 is made by punching and bending of metal plate, the electric wire 2 is crimped to the electric wire connection part 31 with the crimp equipment. On the other hand, the connector housing 4 and the spacer 5 are made of synthetic resin by injection molding.

Figure 6:
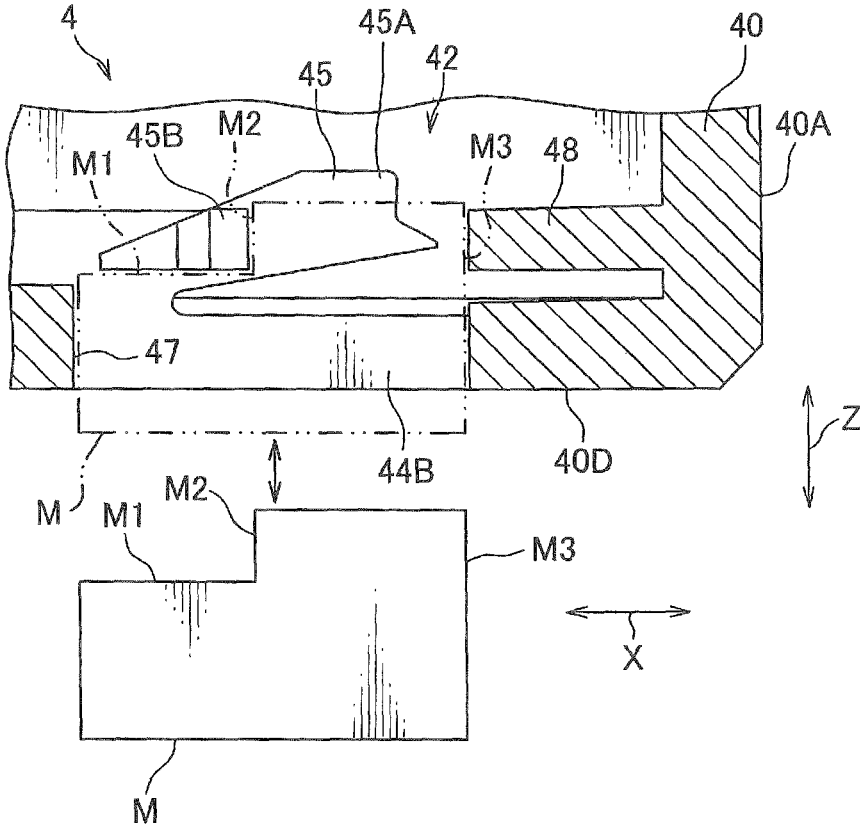
FIG. 6 is a partial cross-sectional view illustrating a method of making the connector.

When the connector housing 4 is injection-molded, as shown in FIG. 6, employed is a slide mold M capable of being inserted into inside the housing main body 40 from the bottom wall 44B of the housing main body 40 through a part destined to become the slit 47. The slide mold M is movably held along the second intersection direction Z, as well as provided with a first mold face M1 molding a bottom wall of the latch projection 45B. Furthermore, the slide mold M includes a second mold face M2 and a third mold face M3 that are inserted into between the latch projection 45B and the abutting part 48, so as to mold these sides. Also, a not-shown main mold is composed of at least a male and female pair capable of opening its mold in the insertion direction X, designed to make the slide mold M insert into any one of male and female molds. Also, the spacer housing 43 and the like are molded using adequate slide mold. Molten resin with the slide mold M inserted inside the main mold is filled within the mold, molding the latch projection 45B by the slide mold M, then the slide mold M is pulled out of the main mold, then the main mold is opened, so as to make the connector housing.

Then, in the assembling procedure of the connector 1, as shown in FIGS. 7A to 8B, firstly, the spacer 5 is preliminarily inserted into the spacer housing 4 to reach the provisional latch position. In this provisional latch position the terminal fitting 3 with the electric wire 2 is inserted into the terminal housing 42 from the back face 40B of the connector housing 4. At this time passing the stabilizer 34 of the terminal fitting 3 through the guide groove 46 makes the terminal fitting 3 to be prevented from falling of descending. Furthermore, inserting the terminal fitting 3 toward the back side the insertion direction X makes a bottom face in a front side of the electric wire contact 32 abut onto the latch lance 45 so as to slidably abut onto the latch arm 45A, and to press the latch arm 45A toward the bottom face 44B to be elastically deformed. Coinstantaneously, the stabilizer 34 is slidably abutted onto the latch projection 45B to elastically deform the latch projection 45B.

Figure 7A:
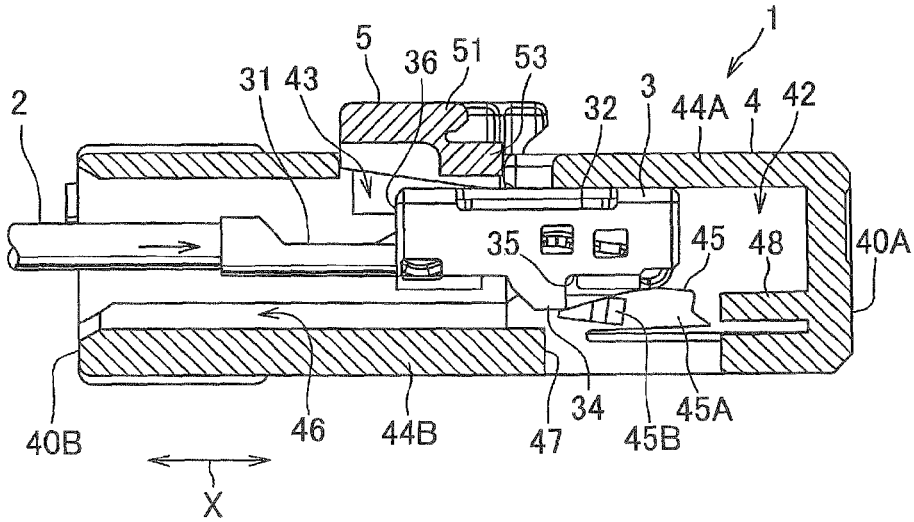
FIG. 7A is a cross-sectional view illustrating an assembling procedure of the connector.
Figure 7B:
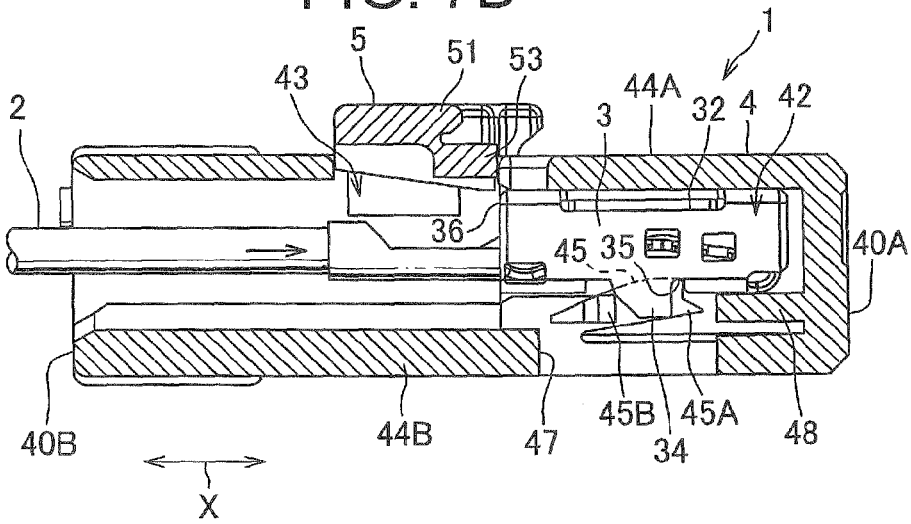
FIG. 7B is a cross-sectional view illustrating the assembling procedure of the connector.

Furthermore, when inserting the terminal fitting 3 into the back of the terminal housing 42, the step 35 of the terminal fitting 3, as shown in FIG. 7B, bridges across the latch arm 45A, and the tip 45C of the latch arm 45A latches the stabilizer 34. The terminal fitting 3 is thereby laid in the provisional latch state two points of the step 35 and the stabilizer 34 are latched in the latch lance 45 of the connector housing 4. Also, a front end of the electric wire contact 32 of the terminal fitting 3 held between inside of the upper wall 44A in the back of the terminal housing 42 and the abutting part 48, so as to be held not movably in the first and second intersection direction Y and Z.

Note that when releasing the provisional latch state and pulling out the terminal fitting 3 from the terminal housing 42, as noted, hooking the jig for pulling the terminal to the latch release projection 45D so as to elastically deform the latch arm 45A toward the bottom wall 44B, releasing the latch of the latch arm 45A and the step 35, as well as releasing the latch of the latch projection 45B and the stabilizer 34 so as to pull the electric wire 2 and pull out the terminal fitting 3 toward its inlet in the insertion direction X.

Figure 7C:
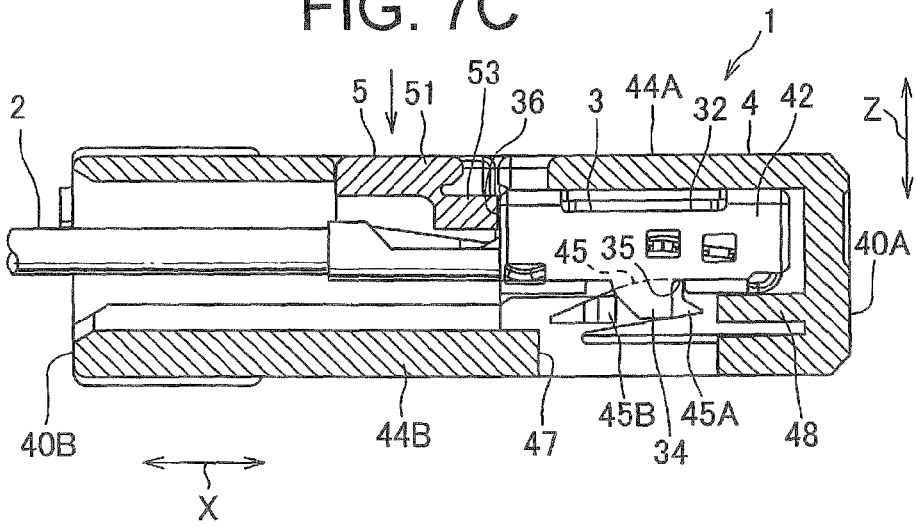
FIG. 7C is a cross-sectional view illustrating the assembling procedure of the connector.
Figure 8A:
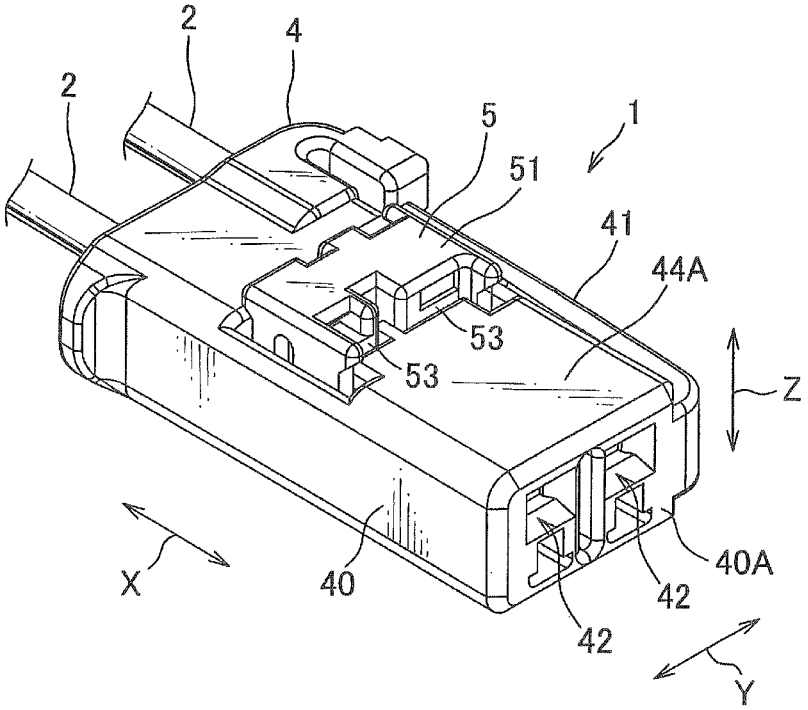
FIG. 8A is a perspective view illustrating an assembling procedure of the connector.
Figure 8B:
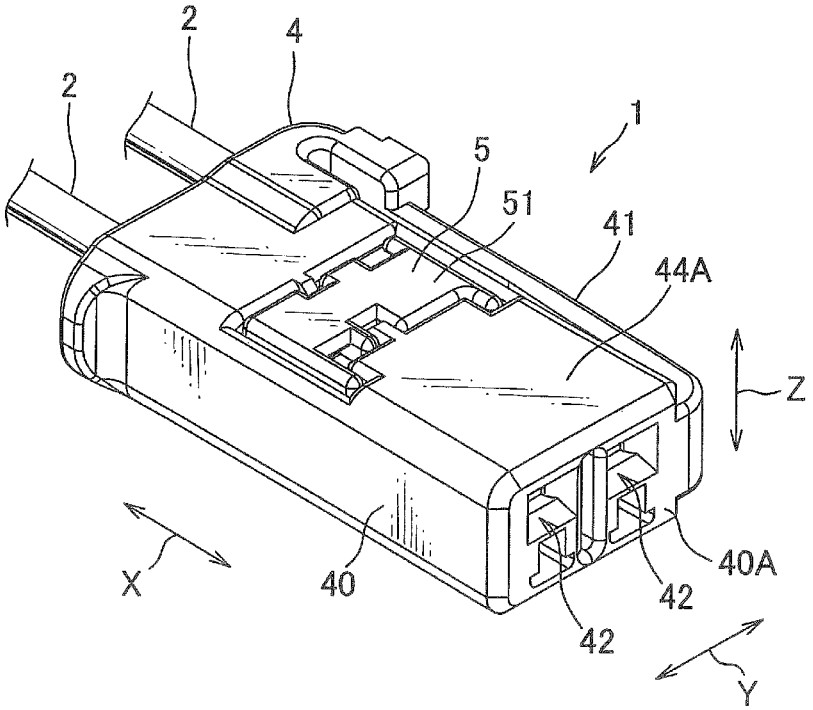
FIG. 8B is a perspective view illustrating the assembling procedure of the connector.
Figure 9:
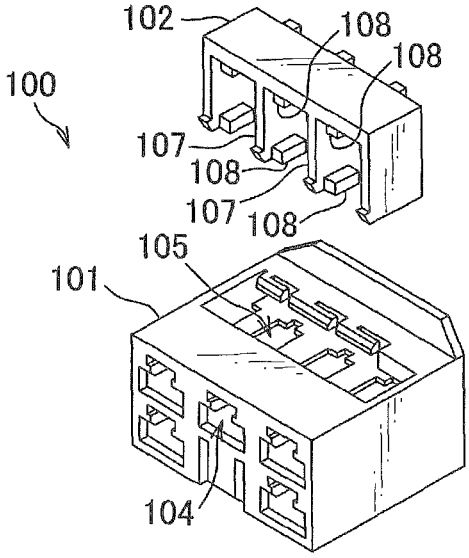
FIG. 9 PRIOR ART
FIG. 9 is an exploded perspective view illustrating one embodiment of a conventional connector.
Figure 10A:
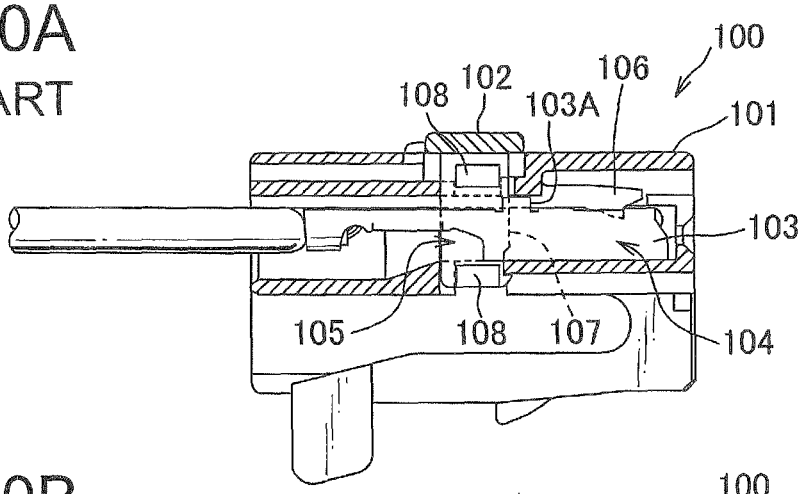
FIG. 10A PRIOR ART
FIG. 10A is a cross-sectional view illustrating the conventional connector.
Figure 10B:
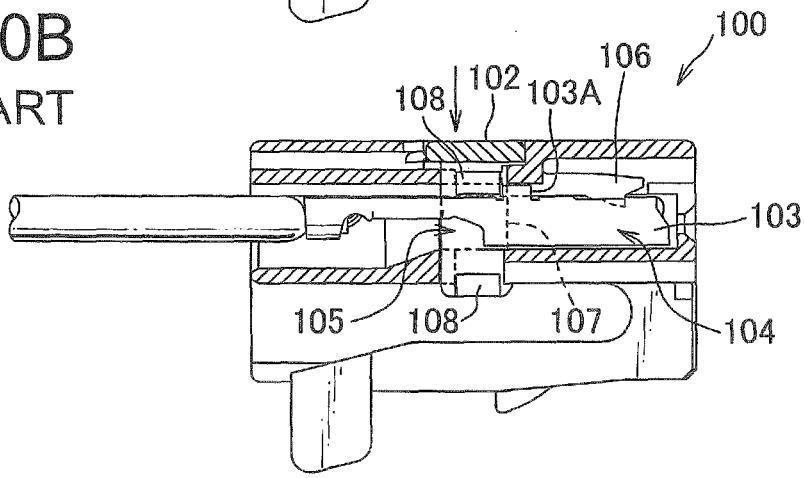
FIG. 10B PRIOR ART
FIG. 10B is a cross-sectional view illustrating the conventional connector.
Figure 11:
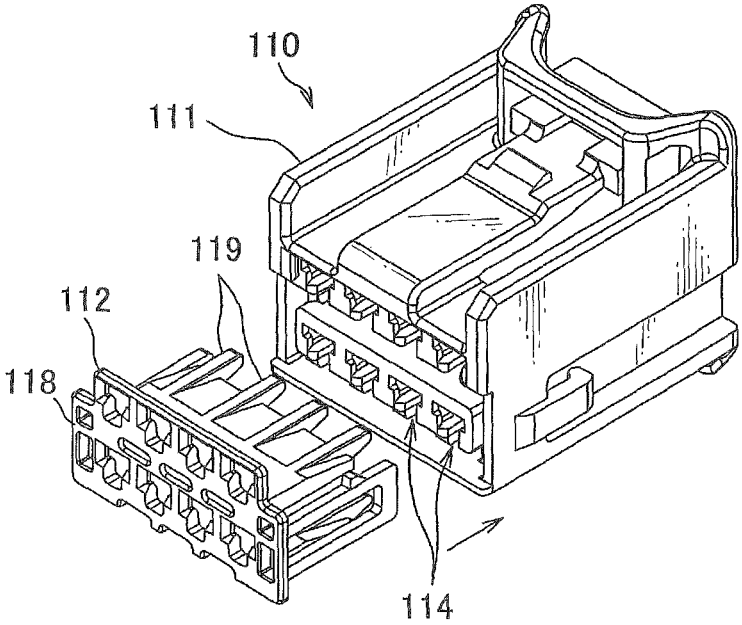
FIG. 11 PRIOR ART
FIG. 11 is an exploded perspective view illustrating another embodiment of the conventional connector.
Figure 12:
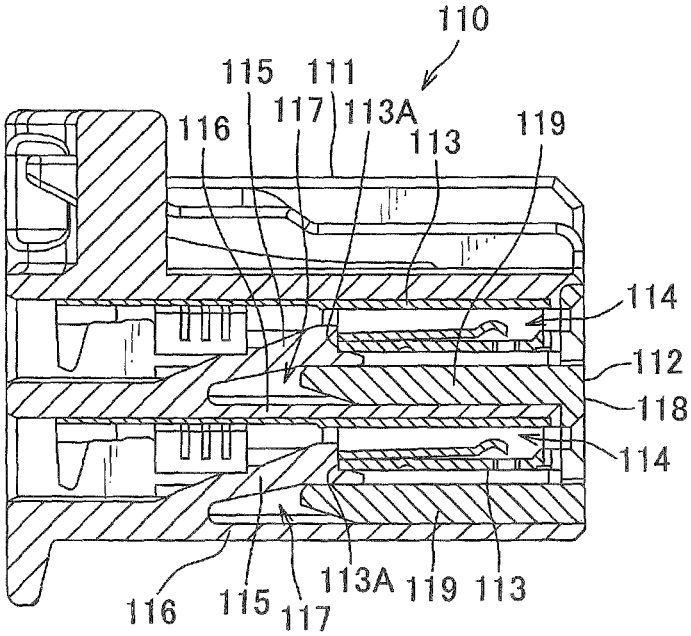
FIG. 12 PRIOR ART
FIG. 12 is a cross-sectional view illustrating the another conventional connector.

Then, in the provisional latch position, the spacer 5 is pressed into the connector housing 4, and latch the spacer main body 51 in the latch piece 43A makes, as shown in FIG. 7C, the spacer 5 move in the actual latch position the spacer 5 is entirely accommodated in the spacer housing 43. In this actual latch position, as aforementioned, two points of the step 35 and the stabilizer 34 are latched in the latch lance 45 as well as the rear end 36 of the electric wire contact 32 is latched in the restrain piece 53 of the spacer 5. This makes the terminal fitting 3 latched in three positions, and laid in the actual latch position its escape is stiffly restrained. The connector is completed through the aforementioned procedure.

According to the present embodiment, in the provisional latch position, the terminal fitting 3 is made to increase its latch force due to the two points of the step 35 and stabilizer 34 being latched in the latch lance 45 of the connector housing 4, and to prevent escape of the terminal fitting 3. Also, the terminal fitting 3 is held between inside of the upper wall 44A in the back of the terminal housing 42 and the abutting part 48, and the motion of the terminal fitting 3 inside the terminal housing 42 is restricted, preventing the latch lance 45 from unlatching, and securely preventing the terminal fitting 3 from escaping. Furthermore, the spacer 5 is moved at the actual latch position so as to abut onto the restriction piece 53, the terminal fitting 3 is thereby latched in the three positions so as to further increase the latch force in the actual latch position.

In the bottom wall 44B of the housing main body 40 the slit 47 is also formed, through which the latch projection 45B is made to expose to external of the housing main body 40, making it possible to readily mold the latch projection 45B using the slide mold M that is inserted into the part where the slit 47 is destined to be formed. Namely, the connector housing 4 of the present embodiment, even if not provided with the conventional front holder in the front side of the housing main body 40, and not pulled out from its front side, can readily mold the latch projection 45B by using the slide mold M that can be inserted from the second intersection direction Z (or the first intersection direction) intersecting the insertion direction X of the terminal fitting 3. The latch projection being readily molded using such the slide mold M, without complication of mold configuration of the injection molding equipment and the molding operation, makes manufacturing cost for the connector hosing 4 reduced.

Note that while the aforementioned embodiment discloses the female connector provided with the terminal fitting 3 that is the female terminal fitting, the connector relevant to the present invention may, not limited to such the female connector, be a male connector that is provided with a male terminal fitting. Also, while in the aforementioned embodiment the connector 1 having the spacer 5 is discussed, the connector of the present invention may, not limited to what is laid in the actual latch position using the spacer or the front holder, be such a configuration in which the terminal fitting is solely latched by the latch part (latch lance 45). Even in such the configuration in which the latch part solely latches the terminal fitting, as aforementioned, latch of the terminal fitting at the two positions of the tip 45C of the latch arm 45A and the latch projection 45B of the latch part can obtain increased latch force.

Also, while in the aforementioned embodiment the connector housing 4 is made to form two points of the terminal housing 42, and the connector 1 which accommodates the two terminal housings 3 is shown, the number and its arrangement of the terminal housing is specifically not limited to. Also, with the connecter housing 4 of the aforementioned embodiment, the spacer housing 43 is disposed open in the upper wall 44A that is an opposite wall, and the slit 47 that is a through hole disposed in the bottom wall 44B that is a wall, but their arrangement are not limited to, whereas the spacer housing 43 and the slit 47 may be formed in the same plane of the connector housing 4, or formed in an intersecting plane to each other. Also, while the aforementioned embodiment includes the configuration where the tip 45C of the latch arm 45A latches the step 35 of the terminal fitting 3, and the latch projection 45B latches the stabilizer 34 of the terminal fitting 3, their part of the first latch part and the second latch part of the terminal fitting are not specifically limited to, but are disposed adequately in the terminal fitting.

INDUSTRIAL APPLICABILITY

The connector and the method for making the connector according to the present invention can be applied to the one composing a wire harness wired, for example, in an automobile, or the one connected to such a wire harness disposed in an electric devices.

REFERENCE SIGNS LIST

1 connector
3 terminal fitting
4 connector housing
5 spacer
34 stabilizer (second latched part, projection piece)
35 step (first latched part)
42 terminal housing
43 spacer housing
44A upper wall (opposite wall)
44B bottom wall (wall part)
45 latch lance (latch part)
45A latch arm
45B latch projection
45C tip
46 guide groove
47 slit (through hole)
48 abutting part
M slide mold

The invention claimed is:

1. A connector, comprising:
a terminal fitting including a first latched part and a second latched part; and
a connector housing, including
a terminal housing accommodating the terminal fitting,
a wall dividing the terminal housing from external, composing one inner face of the terminal housing, and provided with a through hole passing therethrough, and
a latch part configured to latch the terminal fitting accommodated in the terminal housing so as to avoid escape of the terminal fitting, the latch part including
a latch arm having a tip extending from a base end disposed on the inner face of the wall toward a back side in an insertion direction of the terminal fitting, the tip of the latch arm being configured to be latched into the first latched part, and
a latch projection projecting from the latch arm in a direction intersecting the insertion direction of the terminal fitting, exposing to external through the through hole, and configured to be latched into the second latched part.

2. The connector as claimed in claim 1, wherein the inner face of the wall is provided with a guide groove therein, the guide groove extending from an inlet side to the back side in the insertion direction of the terminal fitting in the connector housing, and wherein the terminal fitting is provided with a projection piece configured to be inserted into the guide groove and guided in the insertion direction of the terminal fitting, and wherein the second latched part is composed of a part of the projection piece.

3. The connector as claimed in claim 1, wherein the back side in the insertion direction of the terminal fitting in the terminal housing is provided with an abutting part therein, the abutting part abutting against, and holding a tip of the accommodated terminal fitting, and wherein the abutting part and the latch projection are overlapped to each other in the insertion direction of the terminal fitting.

4. The connector as claimed in claim 2, wherein the back side in the insertion direction of the terminal fitting in the terminal housing is provided with an abutting part therein, the abutting part abutting against, and holding a tip of the accommodated terminal fitting, and wherein the abutting part and the latch projection are overlapped to each other in the insertion direction of the terminal fitting.

5. A method for making the connector as claimed in claim 1, comprising the steps of:
providing a slide mold slidable in the direction intersecting the insertion direction of the terminal fitting upon molding the connector housing;
passing the slide mold through a part where the through hole is destined to is formed; and
molding the latch projection using the slide mold.

6. A method for making the connector as claimed in claim 2, comprising the steps of:
providing a slide mold slidable in the direction intersecting the insertion direction of the terminal fitting upon molding the connector housing;

passing the slide mold through a part where the through hole is destined to is formed; and molding the latch projection using the slide mold.

7. A method for making the connector as claimed in claim 3, comprising the steps of:

providing a slide mold slidable in the direction intersecting the insertion direction of the terminal fitting upon molding the connector housing;

passing the slide mold through a part where the through hole is destined to is formed; and molding the latch projection using the slide mold.

8. A method for making the connector as claimed in claim 4, comprising the steps of:

providing a slide mold slidable in the direction intersecting the insertion direction of the terminal fitting upon molding the connector housing;

passing the slide mold through a part where the through hole is destined to is formed; and molding the latch projection using the slide mold.

* * * * *